United States Patent [19]

Brown et al.

[11] Patent Number: 4,925,363

[45] Date of Patent: May 15, 1990

[54] BLADE RING ROLLOUT ROLLER

[75] Inventors: James R. Brown, Idaho Falls, Id.; Rick A. Olson, Apopka, Fla.

[73] Assignee: Westinghouse Electric Corp., Pittsburgh, Pa.

[21] Appl. No.: 309,748

[22] Filed: Feb. 13, 1989

[51] Int. Cl.[5] ..... F04D 29/60

[52] U.S. Cl. ..... 415/129; 415/133; 384/547; 384/583; 384/626

[58] Field of Search ..... 415/126, 127, 129, 133, 415/132, 118; 384/547, 583, 626; 60/39, 33

[56] References Cited

U.S. PATENT DOCUMENTS

| | | | |
|---|---|---|---|
| 642,123 | 1/1900 | Hoffmann | 384/549 |
| 1,352,276 | 9/1920 | Junggren | 415/214.1 |
| 2,247,387 | 7/1941 | Johnson et al. | 415/126 |
| 2,247,423 | 7/1941 | Webster, Jr. | 415/126 |
| 2,399,189 | 4/1946 | Johnson | 384/549 |
| 2,753,036 | 7/1956 | Joy | 198/10 |
| 2,807,934 | 10/1957 | Purvis et al. | 60/39.31 |
| 3,036,823 | 5/1962 | Taylor | 366/233 |
| 3,174,810 | 3/1965 | Roubal | 384/59 |
| 3,493,212 | 2/1970 | Scalzo et al. | 415/127 |
| 4,343,592 | 8/1982 | May | 415/171 |
| 4,687,411 | 8/1987 | Maeda et al. | 384/626 |
| 4,848,939 | 7/1989 | Ludwig | 384/626 |

FOREIGN PATENT DOCUMENTS

| | | |
|---|---|---|
| 0832135 | 9/1938 | France . |
| 0539894 | 7/1956 | Italy . |
| 0113597 | 7/1983 | Japan . |
| 0003575 | 3/1901 | Switzerland . |
| 0174908 | 9/1965 | U.S.S.R. . |
| 0012629 | of 1899 | United Kingdom . |

*Primary Examiner*—Robert E. Garrett
*Assistant Examiner*—John T. Kwon

[57] ABSTRACT

A roller structure for a rotary machine has a plate that is removably engagable with the outer casing of such rotary machines, a shaft portion attached to the plate and insertable through the outer casing, a bearing mounted for rotation upon the shaft portion, and a selected plurality of shims having different thicknesses engagable upon the shaft portion to adjust the position of the bearing with respect to an inner casing of the rotary machine.

21 Claims, 2 Drawing Sheets

BLADE RING ROLLOUT ROLLER

BACKGROUND OF THE INVENTION

1. Field of the Invention

This invention relates generally to turbines and compressors having inner and outer casings which encompass the rotors and that are divided along a horizontal plane into upper and lower semi-cylindrical halves, and more particularly to an improved method and apparatus for "rolling out" the lower half of the outer casing without the necessity for removing the rotor.

2. Statement of the Prior Art

Axial flow turbines and compressors are typically provided with an inner casing that contains the rows of stationary nozzles for directing the motive fluid past the rotor blading. Such conventional inner casings are disposed within an outer casing structure for many well known reasons.

Since turbines and compressors must, from time-to-time, be disassembled for servicing and/or repairs, the inner and outer casings are divided into upper and lower halves that are removably joined to each other by bolts at suitable horizontal flanges. In a similar manner, the nozzle rows are also divided into upper and lower semi-circular halves so that they may be removed with the associated inner casing half as a unit, and then subsequently removed from the casing for repair or replacement.

Although the upper half of the inner casing is readily accessible for removal by first removing the upper half of the outer casing, the lower half of the inner casing has not been so easily removable. This problem is primarily due to the rotor's being supported in the lower half of the outer casing which interferes with such removal. It would, therefore, be desirable to provide methods and apparatus which facilitate repairs to or replacement of turbines and compressors having inner and outer casings which encompass the rotors and that are divided along a horizontal plane into upper and lower semi-cylindrical halves.

One known means which facilitates such repairs and replacement is disclosed and claimed in U.S. Pat. No. 3,493,212—Scalzo et al., which is assigned to the assignee of the present invention, and is incorporated herein by reference. Scalzo et al. teach an arrangement which not only permits ready removal of the lower half of the inner casing, together with the lower halves of the stationary nozzle rows, but also permits the removal without any preliminary removal of the rotor.

The above arrangement is attained by providing a roller structure that is insertable into the lower half of the outer casing and extends into rollable supporting relation with the inner casing. In such a manner, the inner casing is permitted to be rolled about its central longitudinal axis to an uppermost position in which it is free of the rotor, at which time it may be readily lifted clear of the lower half of the outer casing for repairs or replacement. One problem with the roller structure that is shown and claimed in Scalzo et al. is that it requires a number of precision machined parts which unnecessarily complicate its manufacturing process and increase the cost therefor.

SUMMARY OF THE INVENTION

It is a general object of the present invention to provide methods and apparatus which facilitate repairs to or replacement of turbines and compressors having inner and outer casings which encompass the rotors and that are divided along a horizontal plane into upper and lower semi-cylindrical halves.

More specifically, it is an object of the present invention to provide an improved roller structure for such turbines and compressors.

Briefly, these and other objects according to the present invention are accomplished by a roller structure have a plate that is removably engagable with the outer casing of such turbines or compressors, a shaft portion attached to the plate and insertable through the outer casing, a bearing mounted for rotation upon the shaft portion, and a selected plurality of shims having different thicknesses engagable upon the shaft portion to adjust the position of the bearing with respect to the inner casing of the turbine or compressor.

Other objects, advantages and novel features according to the present invention will become more apparent from the following detailed description thereof when considered in conjunction with the accompanying drawings wherein:

DETAILED DESCRIPTION OF THE INVENTION

Figure 1:
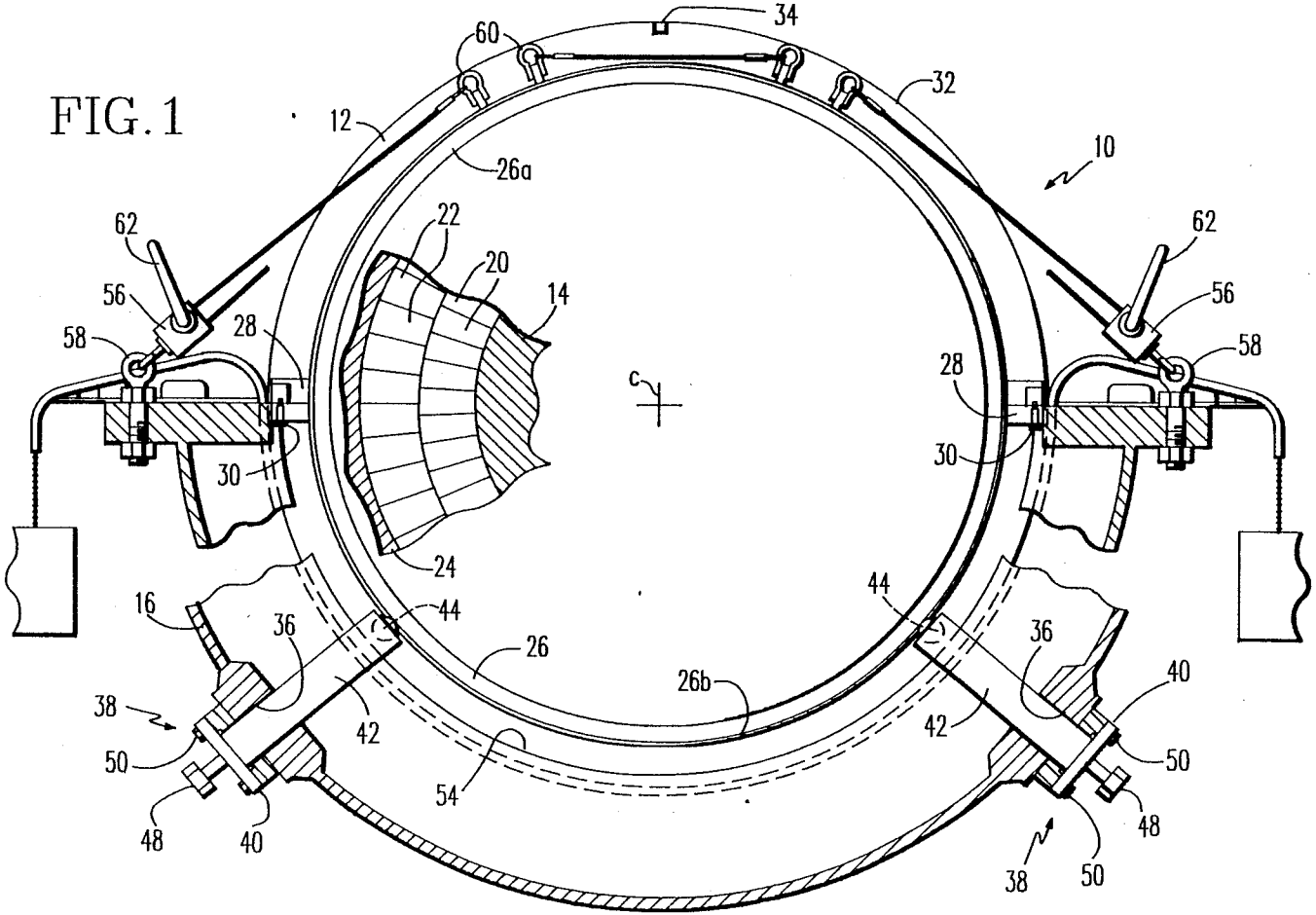
FIG. 1 is a transverse sectional view of an axial flow turbine including a pair of roller structures.
Figure 2:
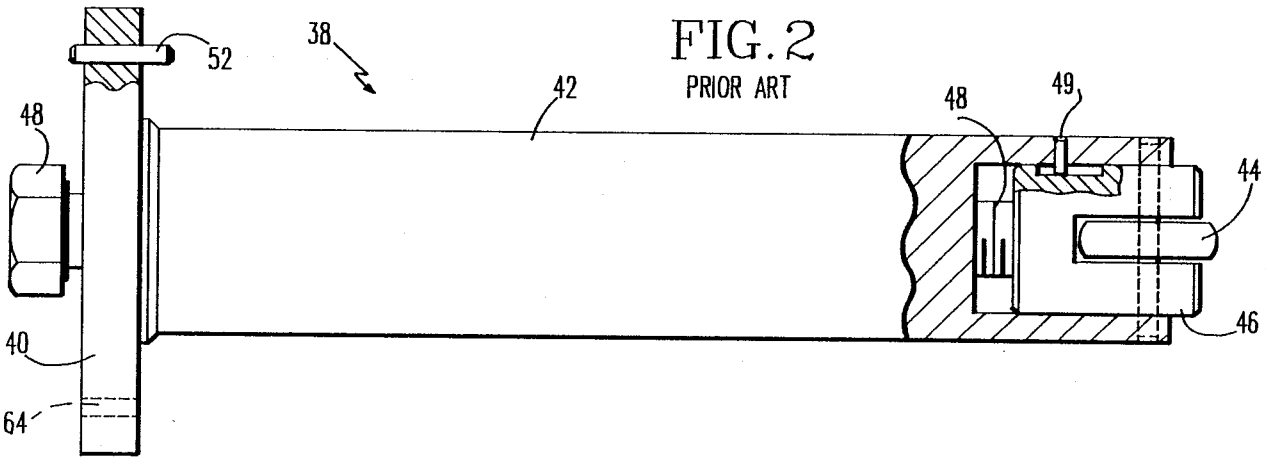
FIG. 2 PRIOR ART
FIG. 2 illustrates, partly in section, the roller structures shown in FIG. 1.

Referring now to the drawings, wherein like numbers designate like or corresponding parts throughout the several views, there is shown in FIGS. 1 and 2, an axial flow power plant or machine 10 of a known type which illustrates prior art roller structures 38 for "rolling out" an inner casing 12 thereof. As is conventional, the turbine rotor 14 is provided with one or more annular rows of radially extending blades 20 extending past and cooperatively associated with a like number of annular rows of stationary nozzle blades 22.

The stationary nozzle blades 22 are carried by suitable outer shroud rings 24 received in a tubular inner "bade ring" or casing 26. As is conventional, the shroud rings 24 are divided into upper and lower halves (not shown), and in a like manner, the inner casing 26 is divided into upper and lower halves **26*a* and 26*b* which are joined together along horizontal flanges 28 by suitable bolts 30. In a typical manner, the inner casing 12 is maintained in concentric spaced relation with the outer casing 16 by a plurality of flanges, such as flange 32, which are keyed thereto by a suitable dowel pin 34**.

The lower outer turbine casing 16 is provided with two apertures 36 disposed in radial alignment with the flange 32 on the inner casing 12. The apertures 36 are angularly displaced with the vertical centerline passing through the center C of the inner casing 12, for example on the order of about 30. However, this angle is not critical and may be considerably greater or less as desired.

A roller structure 38 for insertion in each aperture is provided for attachment to the lower half of the outer casing 16. As is best shown in the enlarged detail of FIG. 2, when viewed in conjunction with FIG. 1, the roller structure 38 includes a mounting plate 40 having a tubular-shaped roller housing 42 attached thereto. The roller housing 42 is of about the same diameter as that of its mating aperture 36 in the outer casing 16. Received within the roller housing 42 is the roller 44 which is suitably supported for rotation by a journal and journal bearings (shown in phantom) within a cylindrical yoke 46.

The cylindrical yoke 46 is held captive by the roller housing 42 and guided thereby for longitudinal movement therein as adjusted by a jack screw 48 within a range of adjustment controlled by a pin 49 engaged to the cylindrical yoke 46. The plate 40 is bolted to the lower half of the outer casing 16 by conventional means such as a plurality of bolts 50 (FIG. 1), and a proper orientation of the roller 44 is assured through means of an indexing pin 52 which is engageable at a preselected point of the outer casing 16.

As was previously explained herein above, the upper half 26*a* of the inner casing 26 is readily removed only after the upper half of the outer casing 16 is first removed. Thereafter, however, the jack screws 48 must be screwed in a radially inward direction to urge the rollers 44 into forcible abutment with the peripheral flange 32. Such jacking movement is continued until the flange 32 is lifted clear of the inner surface 54 so that the inner casing 26 is rollably supported by the rollers 44 and freely rotatable relative to the lower half of the outer casing 16.

Since the inner casing 26 is substantially balanced, only a small torque is required to rotate the lower half 26*b* thereof to the position occupied normally by the upper half 26*a*. This torque may, if desired, be applied by hand by the servicemen and after the lower half 26*b* of the inner casing 26 is so positioned, it may be disassembled from the other half by removing the flange retaining bolts 30, and then lifted clear and removed entirely for service and required repairs as previously described. The thus repaired lower half 26*b* of the inner casing 26 and its nozzles blades 22 may then be reinstalled and returned to its original position by reversing the above procedure.

However, a more preferable and precise manner of rolling the lower half 26*b* of the inner casing 26 to the upper position, in view of its large inertia, is by employment of a pair of chain hoists 56. The chain hoists 56 are anchored to the opposing outer lower half casing flanges by suitable eye bolts 58 and connected to suitable means 60 on the upper half of the inner casing 26. By manipulating the handle 62 of each hoist 56 in a manner to pull up chain from one hoist 56 while letting out chain from the other hoist 56, the inner casing 26 may be rotated with a high degree of precision and control in either direction.

As was noted herein above with respect to the roller structures 38, however, the roller structures 38 such as hat which is illustrated in FIG. 2 are not only expensive, but also are comprised primarily of precision machined parts. Therefore, and referring now to FIG. 3, an improved roller structure 63 according to the present invention will be described.

In accordance with a first important aspect of the present invention, the improved roller structure 63 has a minimum of component parts, none of which require a great deal of precise machining. A conventional, "off-the-shelf" Camrol bearing 66 (e.g., Part No. CYR-1-S or Part No. CCYR-1-S of McGill Mfg. Co., Inc.) is supported within a shaft portion 68 by a conventional, "off-the-shelf" dowel pin 70 (e.g., Part No. 98381AS85 at page 1791 of McMaster-Carr Catalog No. 84) that is press-fitted within a bore 72 through the arm portions formed on either side of a bearing-receiving cavity 74 that is formed in the shaft portion 68.

Figure 3:
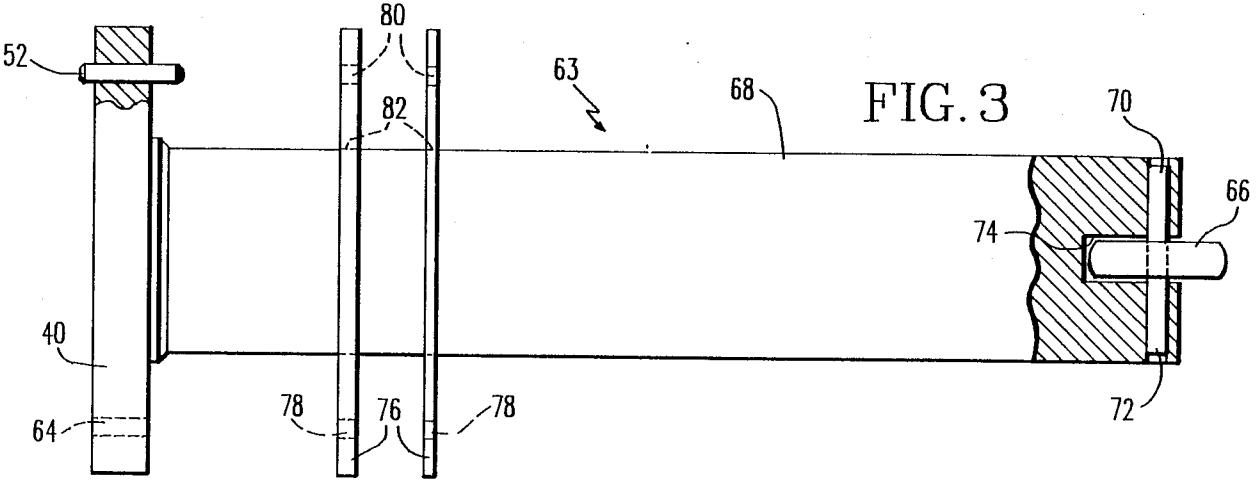
FIG. 3 illustrates, partly in section, an improved roller structure that may be used in the turbine shown in FIG. 1 in accordance with the present invention.

Like the prior art roller structure 38 shown in FIG. 2, the improved roller structure 63 of FIG. 3 includes a plate 40 with an indexing pin 52 and a plurality of bolt-receiving holes 64 bore therethrough to mount the roller structure 63 in position within the apertures 36. However, the improved roller structure 63 unlike the prior art roller structure 38 does not have a jacking screw or a yoke which complicate the machining processes required to manufacture such prior art roller structures.

In lieu of the jacking screws, the improved roller structure 63 utilizes a plurality of shims 76 of various thicknesses which are formed in a manner similar to the formation of the plates 40 to adjustably position the bearing 66 into abutment with the inner casing 26. That is, each of the shims 76 includes a plurality of bolt-receiving holes 78 at points corresponding to the positions of the bolt-receiving holes 64 formed in the plate 40. Moreover, each of the shims 76 include a hole 80 through which the indexing pin 52 is fitted to the outer casing 16, and a central large hole 82 for engagement of the shim 76 upon the shaft portion 68 of the improved roller structure 63.

Since the amount of radially inward adjustment of the bearing 66 necessary to lift the inner casing 26 clear of the inner surface 54 is of a small magnitude that is substantially invariant within a small range of error, all that is necessary for the servicemen to "roll out" the inner casing 26 is to select one or more shims 76 of suitable thickness, place those shims 76 upon the shaft portion 68 of the improved roller structure 63, and bolt such improved roller structure 63 to the outer casing 12. Further adjustments necessitated either by wear and tear of the turbine or compressor or by the site variations experienced during the erection of the turbine or compressor can be accomplished easily through the placement of additional shims 76 as necessary.

Obviously, many modifications and variations are possible in light of the above teachings. It is to be understood, therefore, that within the scope of the appended claims the invention may be practiced otherwise than as is specifically described herein.

What we claim as our invention is:

1. In a rotary machine which includes an inner casing structure having an outer peripheral surface portion of circular cross-section, an outer casing structure having an inner peripheral surface portion of circular cross-section, wherein the inner casing is received in the outer casing with its outer surface portion in mating relation with the inner surface portion, and wherein the outer and inner casings are each divided into upper and lower halves thereof respectively removably joined to each other, the lower half of the outer casing having one or more pairs of apertures bored radially therethrough, improved means for rollably supporting the inner casing in the outer casing comprising in combination therewith:

a shaft portion of substantially cylindrical cross-section adapted to be slidingly engaged within each of the apertures;

a roller bearing attached to an end of each said shaft portion, said end being adapted to be inserted in the aperture for abutment of said roller bearing to the outer peripheral surface of the inner casing;

(one or more shims engagable upon each said shaft portion to adjustably position each said roller bearing with respect to the outer peripheral surface of the inner casing; and means for attaching each said shaft portion with its respective roller bearing positioned by said shims.

2. The improved means according to claim 1, wherein said shaft portion has formed therein at said end a pair of arms separated by a cavity that is adapted to receive said roller bearing, and a hole bored through each said arm.

3. The improved means according to claim 2, further comprising pin means for rotatably supporting said roller bearing within said cavity, said pin means being coupled to said holes bored in each said arm.

4. The improved means according to claim 3, wherein said pin means comprises a dowel pin that is press fit within each said hole.

5. The improved means according to claim 1, wherein said attaching means comprises a plate that is mounted to the other end of said shaft portion, said plate including indexing means for ensuring a selected orientation of said roller bearing with respect to the outer peripheral surface of the inner casing, and bolt means for coupling said plate to the outer casing.

6. The improved means according to claim 5, wherein each said shim comprises a metallic material of a preselected thickness, a hole that is formed centrally therethrough for coaxially mounting said shim upon said shaft portion between said plate and the outer casing, and means for accommodating said indexing means and said bolt means.

7. The improved means according to claim 5, wherein said preselected thickness of each said shim comprises a plurality of different thicknesses.

8. A rotary machine, comprising:

an inner casing structure having an outer peripheral surface portion of circular cross-section;

an outer casing structure having an inner peripheral surface portion of circular cross-section, said inner casing being received in said outer casing with its outer surface portion in mating relation with said inner surface portion, a lower half of said outer casing having a pair of axially aligned apertures bored radially therethrough;

a shaft portion of substantially cylindrical cross-section adapted to be slidingly engaged within each of the apertures;

a roller bearing attached to an end of each said shaft portion, said end being adapted to be inserted in the aperture for abutment of said roller bearing to the outer peripheral surface of the inner casing;

one or more shims engagable upon each said shaft portion to adjustably position each said roller bearing with respect to the outer peripheral surface of the inner casing; and means for attaching each said shaft portion with its respective roller bearing positioned by said shims.

9. The machine according to claim 8, wherein said shaft portion has formed therein at said end a pair of arms separated by a cavity that is adapted to receive said roller bearing, and a hole bored through each said arm.

10. The machine according to claim 9, further comprising pin means for rotatably supporting said roller bearing within said cavity, said pin means being coupled to said holes bored in each said arm.

11. The machine according to claim 10, wherein said pin means comprises a dowel pin that is press fit within each said hole.

12. The machine according to claim 8, wherein said attaching means comprises a plate that is mounted to the other end of said shaft portion, said plate including indexing means for ensuring a selected orientation of said roller bearing with respect to the outer peripheral surface of the inner casing, and bolt means for coupling said plate to the outer casing.

13. The machine according to claim 12, wherein each said shim comprises a metallic material of a preselected thickness, a hole that is formed centrally therethrough for coaxially mounting said shim upon said shaft portion between said plate and the outer casing, and means for accommodating said indexing means and said bolt means.

14. The machine according to claim 12, wherein said preselected thickness of each said shim comprises a plurality of different thicknesses.

15. In a rotary machine which includes an inner casing structure having an outer peripheral surface portion of circular cross-section, an outer casing structure having an inner peripheral surface portion of circular cross-section, wherein the inner casing is received in the outer casing with its outer surface portion in mating relation with the inner surface portion, and wherein the outer and inner casings are each divided into upper and lower halves thereof respectively removably joined to each other, the lower half of the outer casing having one or more pairs of apertures bored radially therethrough, a method of rollably supporting the inner casing in the outer casing comprising in combination therewith:

providing a shaft portion of substantially cylindrical cross-section for each of the apertures;

mounting a roller bearing for rotation attached to an end of each said shaft portion, said end being adapted to be inserted in the aperture for abutment of said roller bearing to the outer peripheral surface of the inner casing;

providing one or more shims to be engagable upon each said shaft portion;

adjustably positioning each said roller bearing with respect to the outer peripheral surface of the inner casing; and attaching each said shaft portion with its respective roller bearing positioned by said shims.

16. The method according to claim 15, further comprising the step of providing said shaft portion at said end with a pair of arms separated by a cavity that is adapted to receive said roller bearing, and a hole bored through each said arm.

17. The method according to claim 16, further comprising the step of providing pin means for rotatably supporting said roller bearing within said cavity, said pin means being coupled to said holes bored in each said arm.

18. The method according to claim 17, wherein said step of providing said pin means comprises:

providing a dowel pin for each said roller bearing; and press fitting each said dowel pin within each said hole.

19. The method according to claim 15, wherein said attaching step comprises:

providing a plate;

mounting said plate to the other end of said shaft portion;

providing said plate with indexing means for ensuring a selected orientation of said roller bearing with respect to the outer peripheral surface of the inner casing, and bolt means for coupling said plate to the outer casing;

coupling said plate to the outer peripheral surface with said bolt means.

20. The method according to claim 19, wherein said shim providing step comprises:

providing a metallic material of a preselected thickness for each said shim;

forming a hole centrally through each said shim for coaxially mounting said shim upon said shaft portion between said plate and the outer casing; and providing each said shim with means for accommodating said indexing means and said bolt means.

21. The method according to claim 19, wherein said preselected thickness providing step comprises providing a plurality of shims of different thicknesses.

* * * * *